US009543656B2

(12) United States Patent
Sato et al.

(10) Patent No.: US 9,543,656 B2
(45) Date of Patent: Jan. 10, 2017

(54) THREE-AXIS ANTENNA

(71) Applicant: TOKO, INC., Tsurugashima-shi, Saitama-ken (JP)

(72) Inventors: Kachiyasu Sato, Tsurugashima (JP); Kazuhisa Sano, Tsurugashima (JP); Kazuhiro Itoh, Tsurugashima (JP)

(73) Assignee: TOKO, INC., Tsurugashima-shi, Saitama-ken (JP)

( * ) Notice: Subject to any disclaimer, the term of this patent is extended or adjusted under 35 U.S.C. 154(b) by 94 days.

(21) Appl. No.: 14/596,844

(22) Filed: Jan. 14, 2015

(65) Prior Publication Data

US 2015/0222016 A1 Aug. 6, 2015

(30) Foreign Application Priority Data

Jan. 31, 2014 (JP) ..... 2014-016545

(51) Int. Cl.

| | |
|---|---|
| ***H01Q 7/06*** | (2006.01) |
| ***H01Q 1/22*** | (2006.01) |
| ***H01Q 1/32*** | (2006.01) |
| ***H01Q 21/24*** | (2006.01) |
| ***H01Q 21/28*** | (2006.01) |
| ***H01Q 21/20*** | (2006.01) |
| ***H01Q 21/06*** | (2006.01) |

(52) U.S. Cl.

CPC ..... *H01Q 7/06* (2013.01); *H01Q 1/2225* (2013.01); *H01Q 1/3241* (2013.01); *H01Q 21/061* (2013.01); *H01Q 21/205* (2013.01); *H01Q 21/24* (2013.01); *H01Q 21/28* (2013.01)

(58) Field of Classification Search

CPC ..... H01Q 7/06; H01Q 1/3241; H01Q 21/205; H01Q 21/24; H01Q 21/28

USPC ..... 343/788, 741, 742, 866, 867, 895

See application file for complete search history.

(56) References Cited

U.S. PATENT DOCUMENTS

| | | | | |
|---|---|---|---|---|
| 6,644,555 | B1 | 11/2003 | Berney | |
| 6,924,767 | B2 * | 8/2005 | Kitahara | H01Q 7/08 343/702 |
| 7,295,168 | B2 * | 11/2007 | Saegusa | H01Q 7/00 343/787 |
| 8,077,106 | B2 * | 12/2011 | Sato | H01Q 1/3241 343/787 |
| 8,378,912 | B2 * | 2/2013 | Nishino | H01Q 1/3241 343/788 |

(Continued)

FOREIGN PATENT DOCUMENTS

| | | | |
|---|---|---|---|
| DE | 601 23 087 | T2 | 4/2007 |
| EP | 1 237 225 | A1 | 9/2002 |
| GB | 2469209 | A | 10/2010 |

OTHER PUBLICATIONS

EP Search Report (Application No. 15152948.4) (9 pages—dated May 27, 2015).

*Primary Examiner* — Tho G Phan

(74) *Attorney, Agent, or Firm* — Renner, Kenner, Greive, Bobak, Taylor & Weber

(57) ABSTRACT

A three-axis antenna having a first to a third antenna coils arranged so that directions of the maximum reception sensitivities are orthogonal to each other, the first to the third antenna coils comprising respectively: a planar coil being wound around the winding axis in circumferential direction and has an aperture; and a foil-type core inserted in the aperture; the foil-type core being arranged a plane to be in parallel to the plane of the first to the third coils.

6 Claims, 15 Drawing Sheets

(56) References Cited

U.S. PATENT DOCUMENTS

| | | | | |
|---|---|---|---|---|
| 8,451,184 | B2 * | 5/2013 | Murakami | H01Q 1/3241 343/788 |
| 8,638,268 | B2 * | 1/2014 | Yosui | H01Q 1/2225 343/787 |
| 2003/0107523 | A1 | 6/2003 | Yahata et al. | |
| 2003/0222829 | A1 | 12/2003 | Kitahara et al. | |
| 2008/0074270 | A1 | 3/2008 | Ashwood-Smith et al. | |
| 2012/0176283 | A1 | 7/2012 | Yosui et al. | |

* cited by examiner

THREE-AXIS ANTENNA

CROSS REFERENCE TO RELATED APPLICATIONS

This application is based upon and claims the benefit of priority from the prior Japanese Patent Application No. 2014-016545, filed on Jan. 31, 2014, the entire contents of which are incorporated herein by reference.

BACKGROUND OF THE INVENTION

1. Field of the Invention

The present invention relates to an omni-directional reception sensitivity three-axis antenna which is used in a receiving device of a keyless entry system for locking or unlocking a vehicle, etc.

2. Description of the Related Art

As an antenna for LF band, a bar antenna which consists of wire wound around a bar-type core winding axis is used. Such a bar antenna has a reception sensitivity in the direction of the winding axis and does not have that in directions orthogonal to the winding axis. Therefore, plural antenna coils mutually compensate for their respective area lacking reception sensitivity by arranging three antenna coils such that the respective winding axes orthogonally cross each other, an omni-directional antenna having omni-directional reception sensitivity is obtained.

In recent years, a small-sized three-axis antenna, having three coils wound orthogonally to each other around a single core, as shown in Japanese patent laid-open No. 2004-15168, is used widely.

FIG. 15 shows an example of a prior art three-axis antenna. As shown in FIG. 15, a conventional three-axis antenna 70 is configured by a core 80 consisting of an externally flat disk-type ferrite core 80, on which circumference surface, mutually orthogonally crossing on the top and bottom surface of the core 80, an x groove 81, a y groove 82 and a z groove 83 are provided, with an x axis coil 91, a y axis coil 92 and a z axis coil 93 are respectively wound around the x groove 81, the y groove 82 and the z groove 83.

The three-axis antenna 70 has omni-directional reception sensitivity due to the winding axes of the x axis coil 91, the y axis coil 92 and the z axis coil 93 being orthogonal to each other.

SUMMARY OF THE INVENTION

Problem to be Solved by the Invention

Although the above-mentioned prior art three-axis antenna is low-profiled, its thickness exceeds 3 mm. Thus, it may be incorporated in a key holder or the like, but not in a thin article like an IC card standardized at 85.6 mm width, 54.0 mm height and 0.76 mm thickness.

Means for Solving the Problem

The present invention is characterized by the provision of:

a three-axis antenna having a first to a third antenna coils whose directions of a maximum reception sensitivity are orthogonal to each other, wherein the first to third antenna coils comprising respectively:

a planar coil which is wound around a winding axis in a circumferential direction and has an aperture; and a foil-type core inserted in the aperture of said coil;

the foil-type cores are arranged in a plane to be in parallel to the plane of the first through the third coils.

Effect of the Invention

According to the three-axis antenna of the present invention, a three-axis antenna which can be incorporated in a thin article like an IC card, etc, may be obtained.

DETAILED DESCRIPTION OF THE PREFERRED EMBODIMENTS

Figure 1:
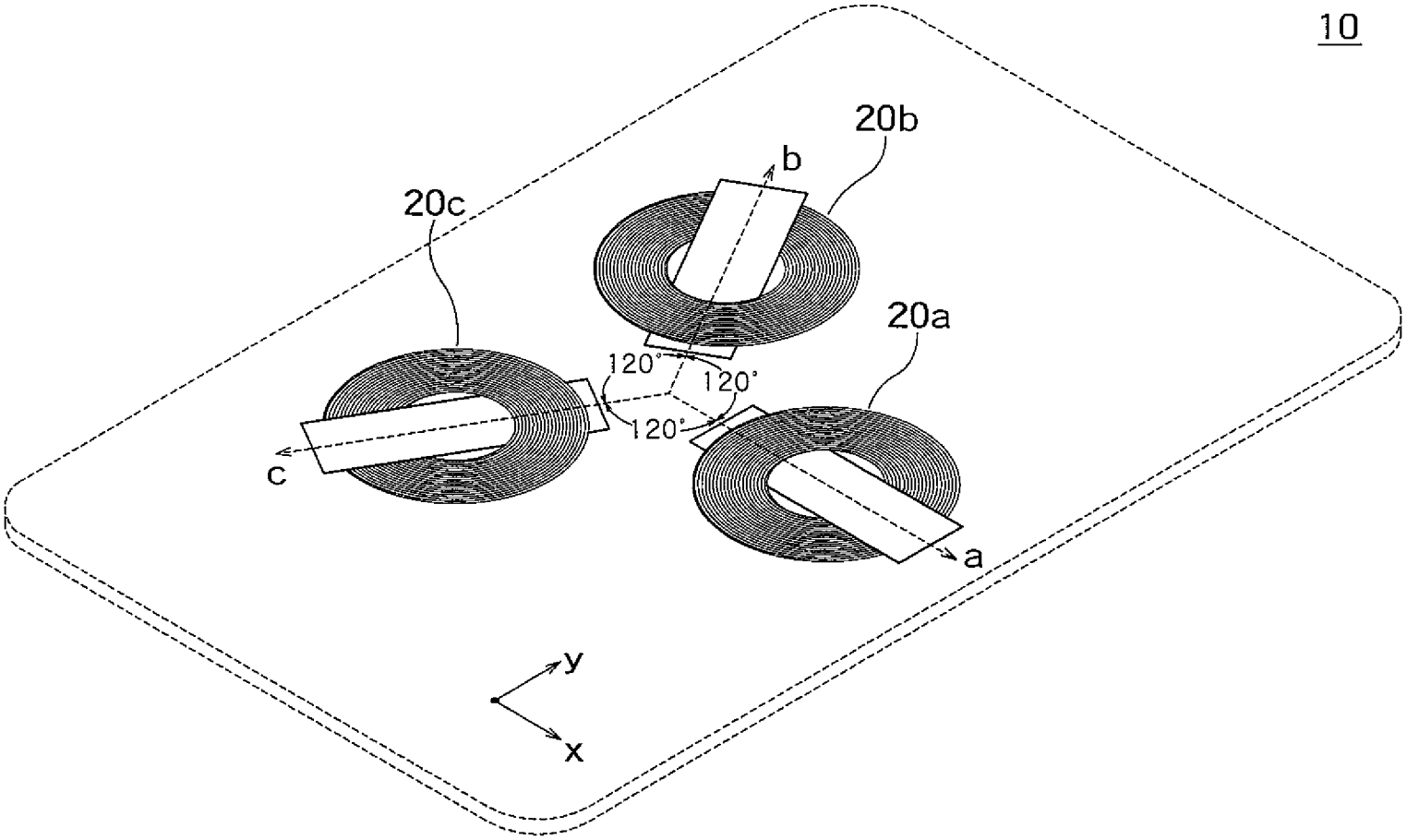
FIG. 1 is a perspective view of an embodiment of the three-axis antenna of the present invention.
Figure 2A:
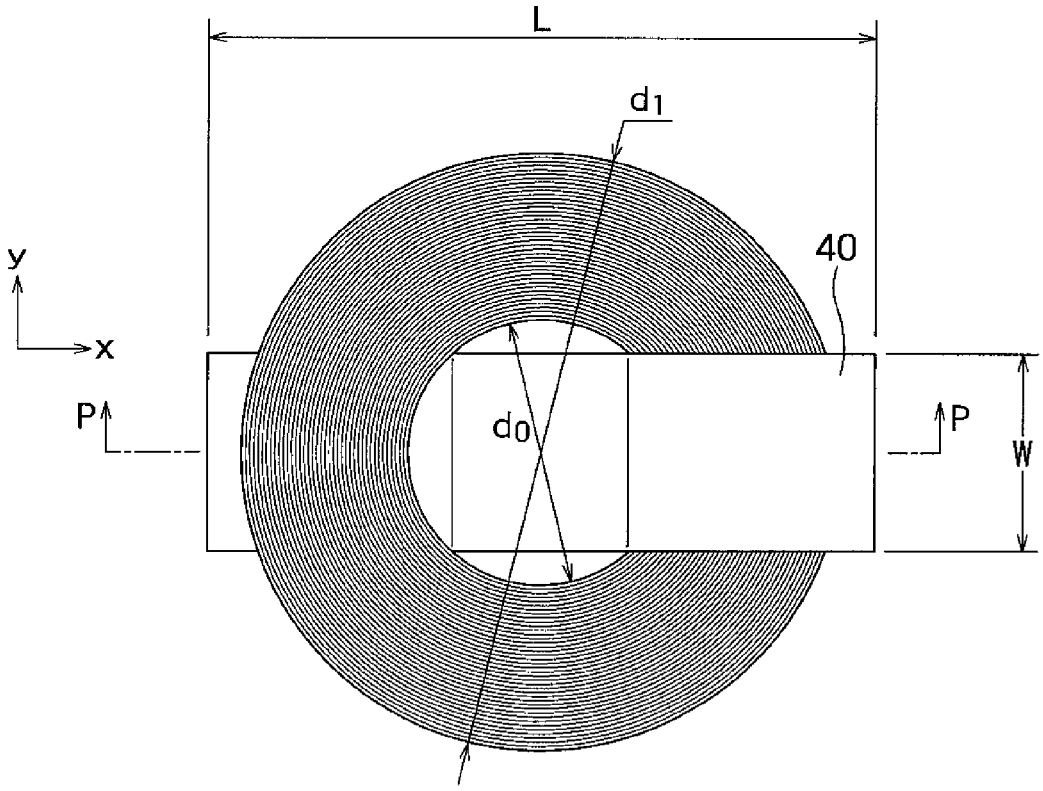
FIG. 2A is a plan view of an antenna coil in the embodiment.
Figure 2B:
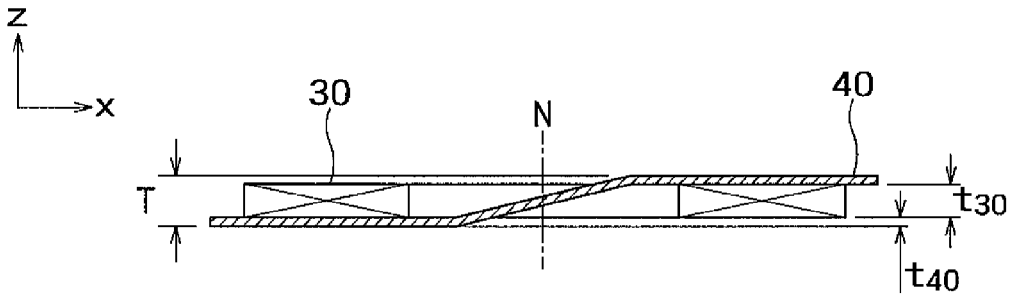
FIG. 2B is a longitudinal sectional view of the antenna coil.

FIG. 1 is a plan view of an embodiment of a three-axis antenna according to the present invention. FIGS. 2A and 2B are a plan view and a sectional view thereof for showing an antenna coil employed in the three-axis antenna.

As shown in FIG. 1, the three-axis antenna 10 includes three planar antenna coils 20*a*, 20*b* and 20*c* arranged on the x-y plane.

The antenna coils 20*a*, 20*b*, 20*c* include, as shown in FIGS. 2A and 2B, a flat-shaped planar coil 30 of inner diameter $d_0$, outer diameter $d_1$ and thickness $t_{30}$, insulation coated wire being wound circumferentially around the winding axis N, and a rectangular foil-type core (foil core, hereunder) 40 of length L, width W and thickness $t_{40}$, a thin film of soft magnetic material being formed on the base material of PET, etc.

The foil core 40 is made of a base material of a nonmagnetic material with a magnetic foil adhered thereto, is arranged to be roughly parallel with the plane and at about 90° from the winding axis N of the planar coil 30 so that the bottom surface at the one end of the foil core 40 contacts the top surface of the planar coil 30, and the top surface at the other end of the foil core 40 contacts the bottom surface of the planar coil 30.

Designating the longitudinal directions of the foil core 40 of the respective antenna coil 20*a*, 20*b* and 20*c* as the a axis, the b axis and the c axis, the a axis, the b axis and the c axis are arranged radially and cross at one point so that the axes make an angle of 120° with each other.

Hereunder, the omni-directionality of the three-axis antenna 10 and the conditions thereof will be the explained.

Figure 3:
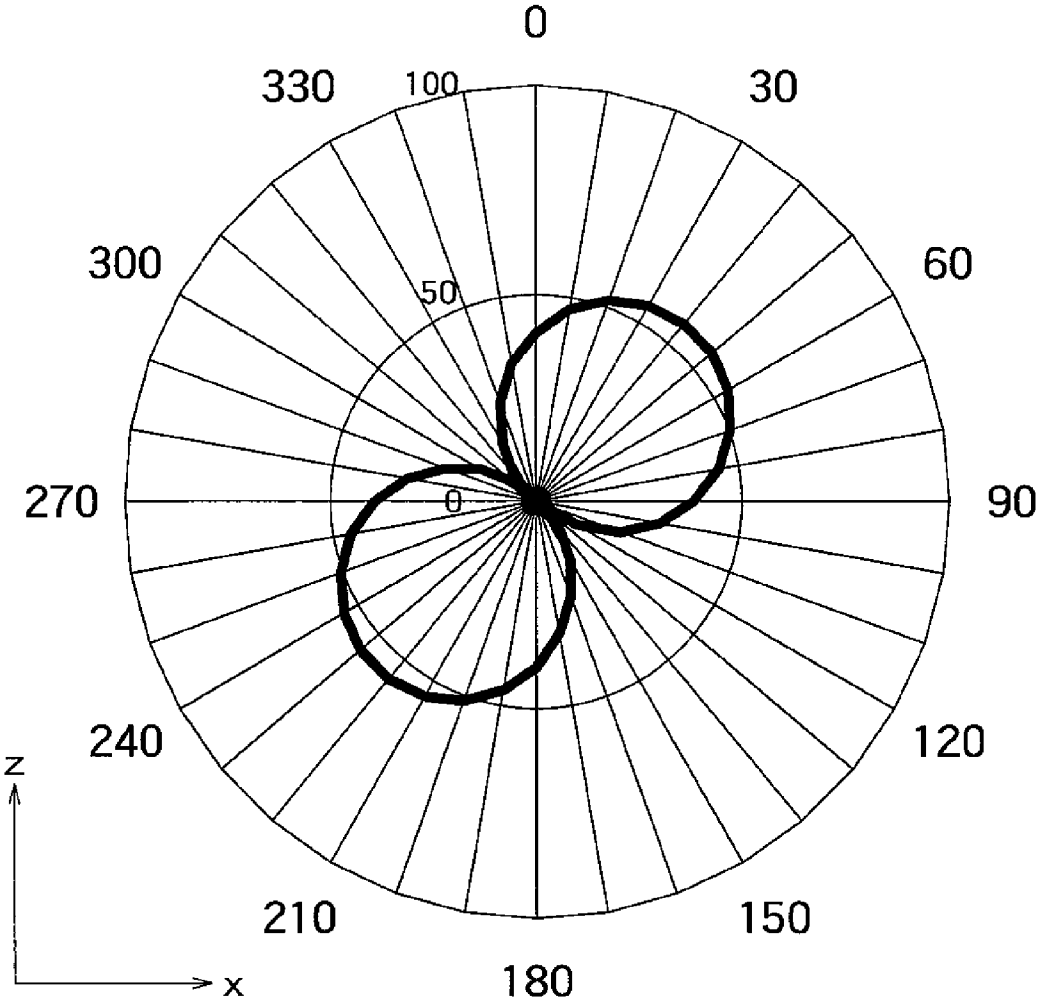
FIG. 3 is a graph showing the radiation characteristics of the antenna coil.

FIG. 3 is a graph showing the radiation characteristics of the antenna coils in FIGS. 2A and 2B. In FIG. 3, the longitudinal direction of the foil core 40 is designated as the x direction and the winding axis N of the planar coil 20*a* is designated as the z axis. Here, the planar coil 30 is constructed by winding, for 332 turns, self-fusion wire of 0.045 mm diameter, with inner diameter $d_0$=8 mm, outer diameter $d_1$=19 mm, thickness $t_{30}$=0.2 mm, and the foil core 40 has relative permeability $\mu_r=10^4$, the length L=20 mm, the width=6 mm and the thickness=0.060 mm.

Figure 4:
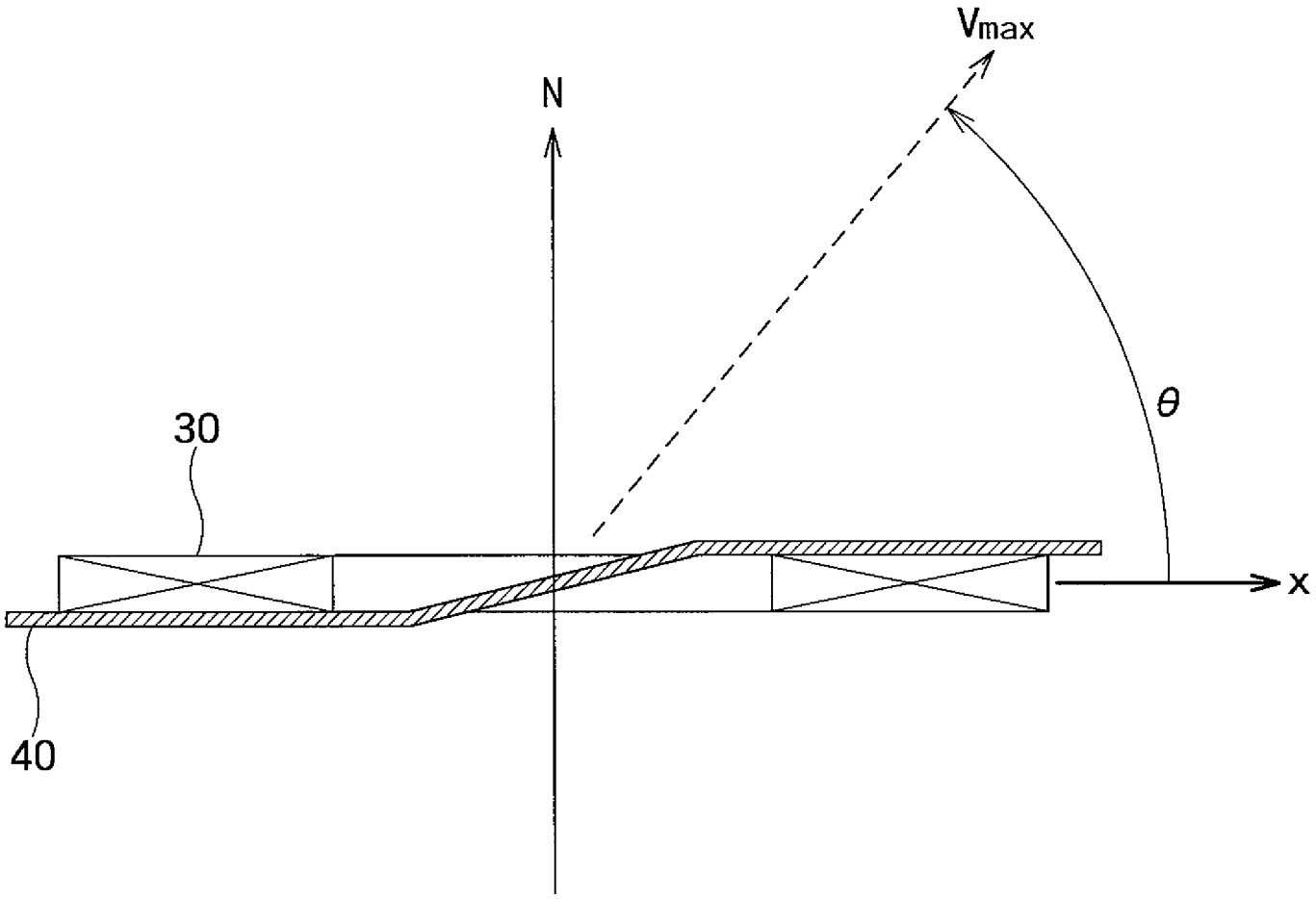
FIG. 4 is a sectional view showing the radiation characteristics of the antenna coil.

Conventional bar-type antennas wound around a bar-type core have a maximum reception sensitivity and generate maximum induced voltage in the longitudinal direction. On the contrary, in the antenna coils shown in FIGS. 2A and 2B the direction of the maximum reception sensitivity, namely, the direction generating the maximum induced voltage Vmax forms the inclination angle θ (0°≤θ≤90°) with a plane perpendicular to the plane of the planar coil 30, as shown in FIG. 4. The angle θ in FIG. 4 is about 50°.

Here, the maximum reception sensitivity is the maximum induced voltage generated in an antenna coil when the antenna coil is located in the magnetic field of 1 μT.

The inclination angle θ, together with the maximum induced voltage Vmax, can be adjusted by varying the shape of the foil core 40, relative permeability $\mu_r$, etc.,. Namely, the inclined angle θ will be smaller if the length L is longer, the sectional area is larger or the relative permeability is increased.

Figure 5:
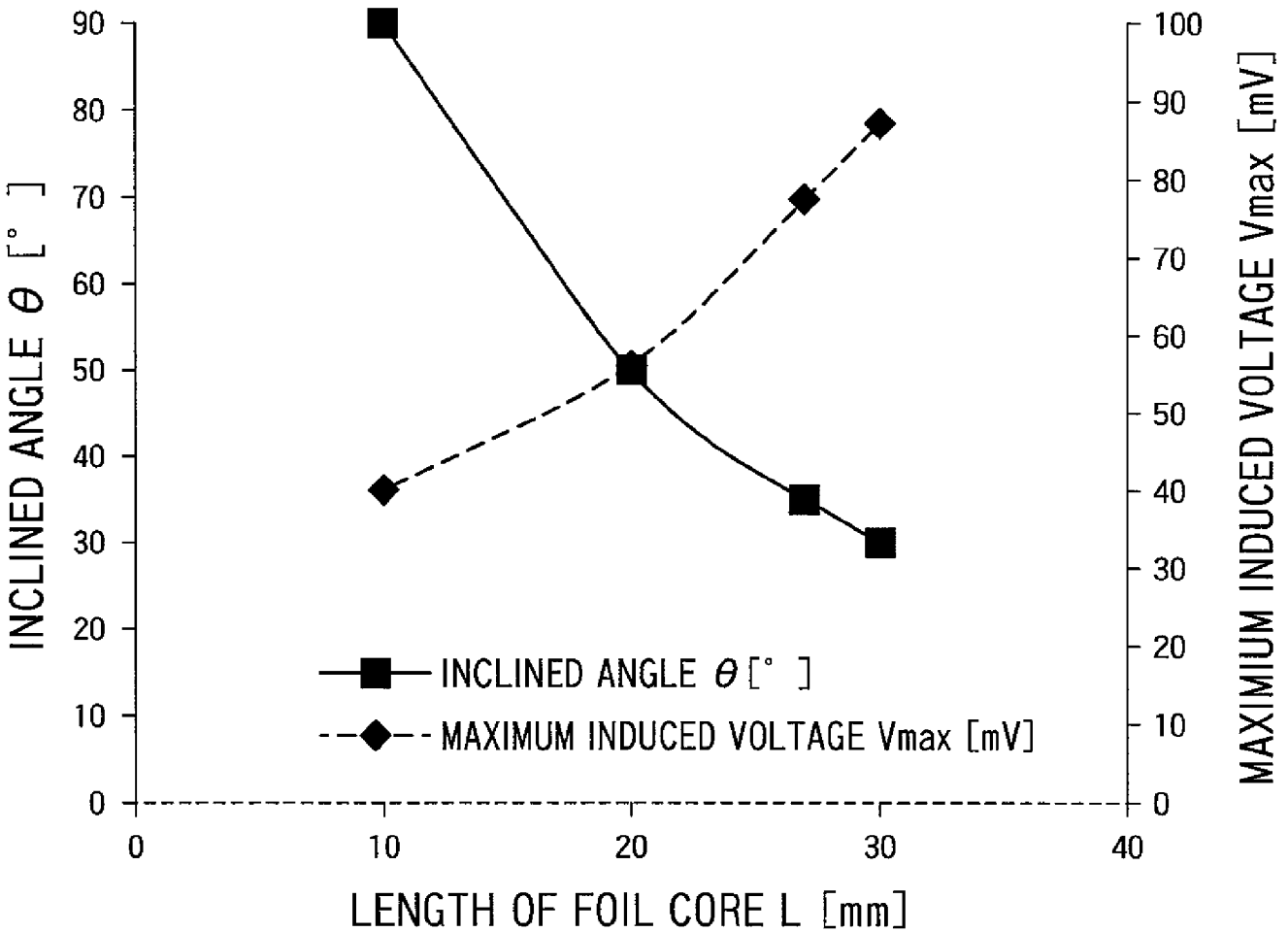
FIG. 5 is a graph showing the characteristics of the antenna coil.

FIG. 5 is a graph showing the variations of the inclination angle θ and The maximum induced voltage Vmax when the longitudinal length L of the foil core 40 is modified. In FIG. 5, the horizontal axis represents the longitudinal length L [mm] of the foil core, and the vertical axes represent the inclination angle θ[°] and the maximum induced voltage Vmax [V], wherein the solid line representing the inclination angle θ and the dotted line representing the maximum induced voltage Vmax. The planar coil is the same as that of the antenna coil used in the measurement of radiation characteristics in FIG. 3.

It will be understood from FIG. 5 that the longer the longitudinal length L of the foil core is, the smaller the inclination angle θ and the larger the maximum induced voltage Vmax are.

Figure 6:
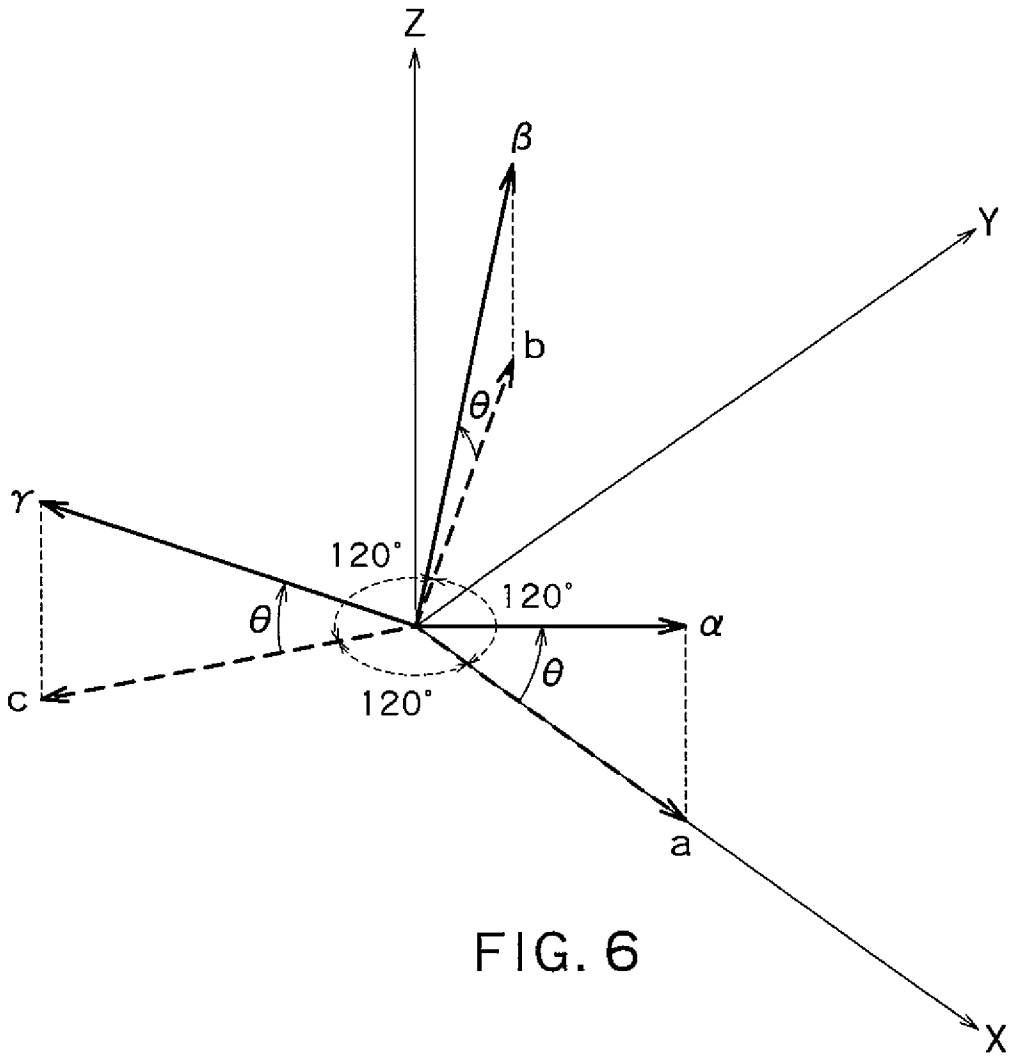
FIG. 6 is a diagrammatic elevation view showing the direction of the maximum reception sensitivity of the three-axis antenna according to the present invention.

FIG. 6 is a diagrammatic elevation view showing the directions of the maximum reception sensitivity of the antenna coils 20*a*, 20*b*, 20*c* (not shown) in the three-axis antenna. In FIG. 6, supposing the longitudinal direction of the foil core of the antenna coil 20*a* is the a axis, the direction of the maximum reception sensitivity is the α axis, and the inclination angle is θ, supposing the longitudinal direction of the foil core of the antenna coil 20*b* is the b axis, the direction of the maximum reception sensitivity is the β axis, and the inclination angle is θ, supposing the longitudinal direction of the foil core of the antenna coil 20*c* is the c axis, the direction of the maximum reception sensitivity is the γ axis, and the inclination angle is θ, and supposing the a axis is the x axis, the angles between the a axis, the b axis and the c axis are 120° respectively and the axes cross each other at the point of origin o.

As shown in FIG. 6, to render omni-directional the three-axis antenna 10, the sufficient condition is that, since the α axis, the β axis and the γ axis cross orthogonally each other, the inclination angle θ formed is 35.26°. From the graph of FIG. 5, the longitudinal length L of the foil core 40 for getting the inclination of 35.26° is about 27 mm.

Figure 7A:
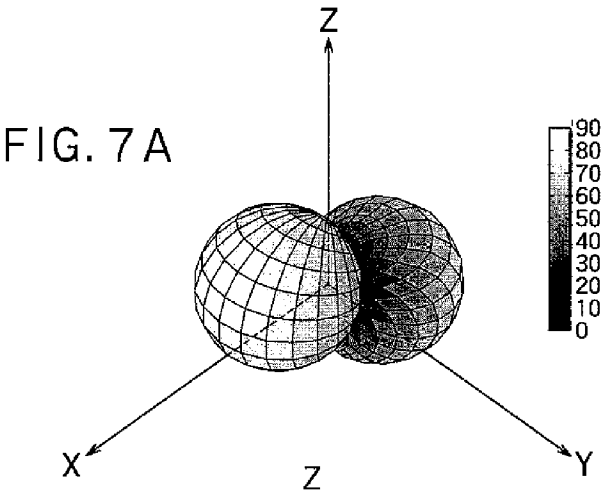
FIGS. 7A through 7D show simulations of the radiation characteristics of the three-axis antenna according to the present invention.
Figure 7B:
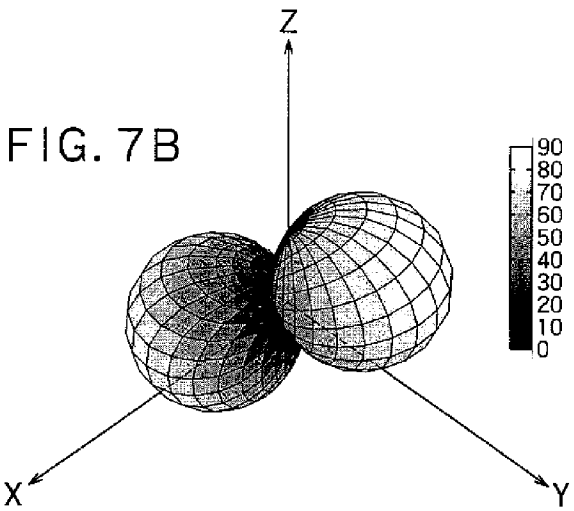
Figure 7C:
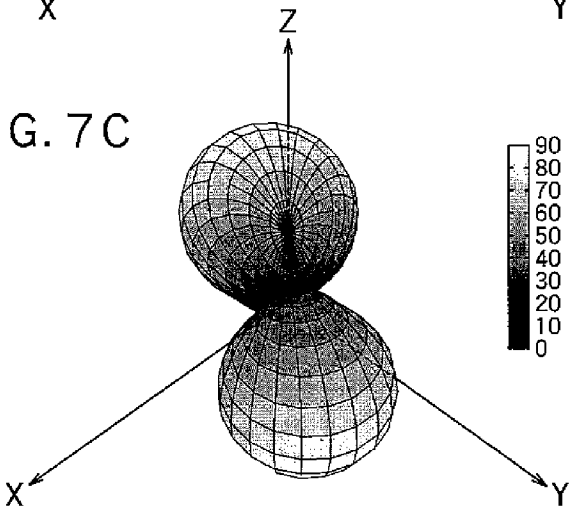
Figure 7D:
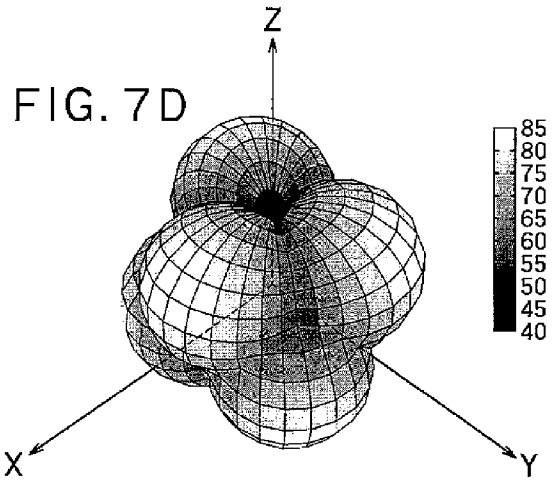

FIGS. 7A through 7D show radiation characteristics as results of simulations using the antenna coils 20*a*, 20*b*, 20*c* with the inclined angle 35.26° for the three-axis antenna 10, wherein FIG. 7A shows radiation characteristics of the antenna coil 20*a*, FIG. 7B shows radiation characteristics of the antenna coil 20*b*, FIG. 7C shows radiation characteristics of the antenna coil 20*c*, and FIG. 7D shows radiation characteristics of the three-axis antenna 10 obtained by logical sum of the radiation characteristics of the antenna coils 20*a*, 20*b* and 20*c*.

As shown in FIG. 7D, the three-axis antenna 10 is an omni-directional antenna having omni-directional reception sensitivity.

The thickness T (=$t_{40}$+$t_{30}$×2, shown in FIG. 2B) of the abovementioned antenna coil is about 0.32 mm. This is thinner than the thickness of the base material, obtained by excluding the respective 0.20 mm thicknesses of the top and bottom surfaces of the exterior from the thickness 0.76 mm of an IC card, so that the three-axis antenna 10 can be embedded into an IC card.

In addition, such three-axis antenna 10, using the foil core and the thin planar coil, being different from conventional three-axis antennas that use brittle ferrite, which are expected to have moderate flexibility is ideal for incorporating it in IC cards, etc.

Besides, the inclined angle 35.26° is ideal in theory but the antenna coils have reception sensitivity even a slightly away from the maximum reception sensitivity direction. Therefore, even if there are differences in the inclined angle θ and the arrangement of the antenna coils, the areas of each not having reception sensitivity are mutually complimentary so that the antenna is omni-directional.

Figure 8:
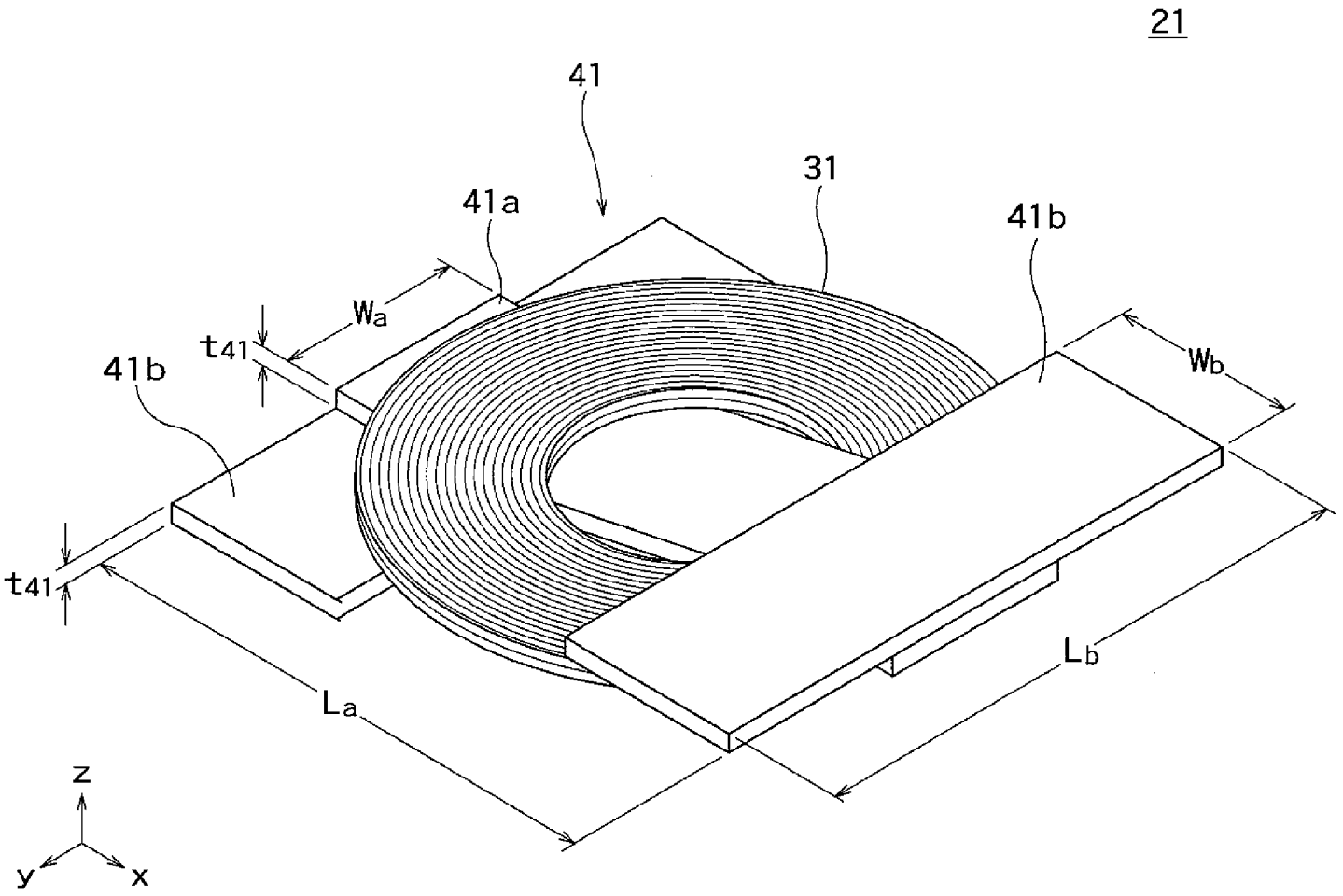
FIG. 8 is a perspective view of an alternative antenna coil.

Not limited to a rectangular shape, the foil core can also be H-shaped. FIG. 8 is a perspective view of another embodiment of an antenna coil for a three-axis antenna.

As shown in FIG. 8, the antenna coil 21 comprises a planar coil 31, an H-shaped foil core 41 inserted into a hole of the planar coil 31. The foil core 41 comprises a rectangular core piece 41*a*, of length $L_a$, width $W_a$ and thickness $t_{41}$, and two rectangular core pieces 41*b* arranged at the opposite ends of the core piece 41*a*, of length $L_b$, width $W_b$ and thickness $t_{41}$.

Figure 9:
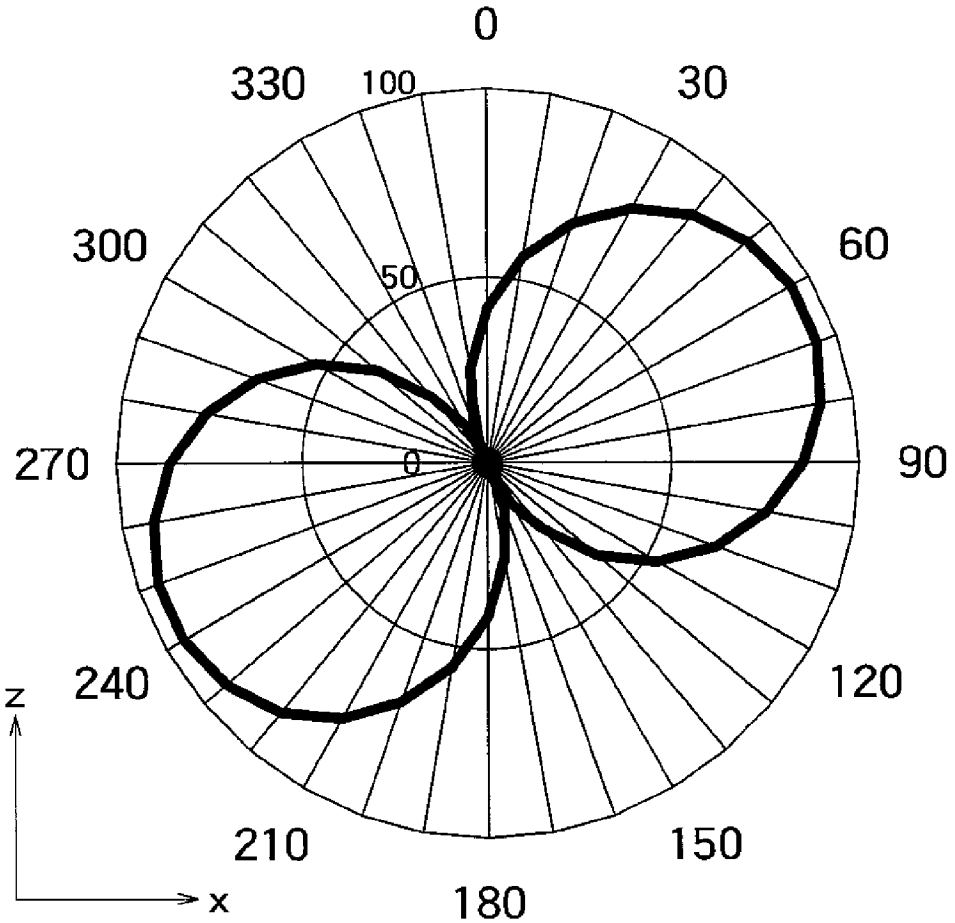
FIG. 9 is a graph showing the radiation characteristic of the alternative antenna coil.

FIG. 9 is a graph showing the radiation characteristics of the antenna coil 21 in FIG. 8, where $W_a$=$W_b$=6 mm, $L_a$=$L_b$=20 mm, $t_{41}$=0.060 mm. The planar coil 31 is the same as the planar coil to be used in the antenna coil, whose measured radiation characteristics are shown in FIG. 3. FIG. 9 reveals that the antenna coil 21 generates higher maximum induced voltage and has a less inclined angle θ, compared to the antenna coil 20 (FIG. 1).

Thus, the maximum induced voltage and the inclined angle are adjustable and depend on the shape of the foil core. Also, the inductance value of the antenna coil 21 are increasing when compared to those of the antenna coil 20. Moreover, the maximum induced voltage is adjustable by the number of windings of the antenna coil 20.

Figure 10A:
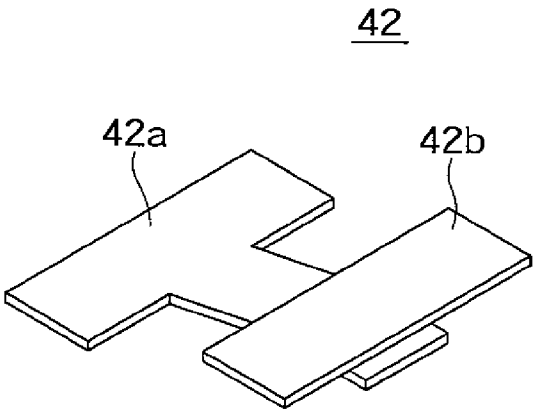
FIGS. 10A through 10E show various foil cores.

FIGS. 10A through 10E are perspective views of various embodiments 42-46 of foil cores to be used in antenna coils. FIG. 10A shows an example where an H-shaped foil core 42, configured by combining a T-shaped core piece 42*a* and an I-shaped core piece 42*b*. Since the overlapping of core pieces is limited at one portion, the thickness of the antenna coil can be suppressed.

Figure 10B:
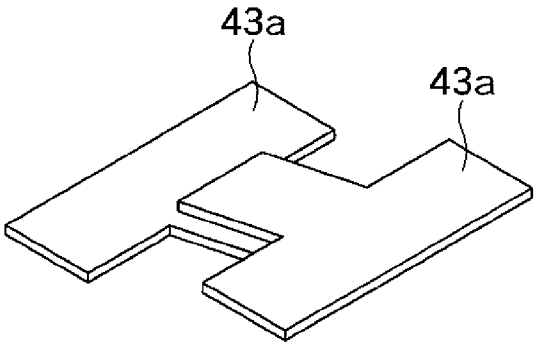

FIG. 10B shows an example of an H-shaped foil core 43 configured by combining two T-shaped core pieces 43*a*, 43*a*. Since the core pieces overlapped over the hole of the planar coil, the overlapped portion does not affect the thickness of the antenna coil. As a result, the thickness of the antenna coils can ever further suppressed.

Figure 10C:
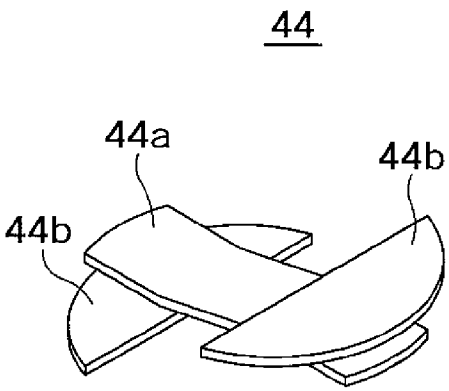

FIG. 10C shows an example of an H-shaped foil core 44, configured by combining an I-shaped core piece 44*a* and an ark-shaped core pieces 44*b*, 44*b*. Since the outer shape of the foil core 44 matches the outer shape of the planar coil, the dedicated area of the antenna coil can be reduced.

Figure 10D:
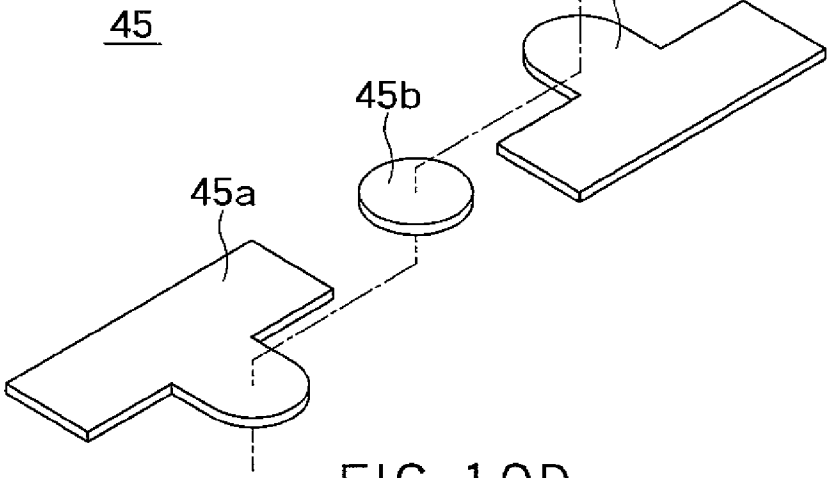

FIG. 10D shows an example of an H-shaped foil core 45, configured by combining two T-shaped core pieces 45*a*, 45*a* and a core piece 45*b* arranged over a hole of the planar coil. Since the core pieces overlap in the hole of the planar coil, the overlapped portion does not affect the thickness of the antenna coil.

Figure 10E:
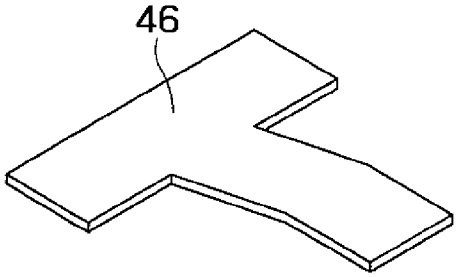

FIG. 10E shows an example of a foil core 46 which is T-shaped. As seen above, a foil core can be asymmetrical in an axial direction. Nevertheless, even if the foil core is asymmetrical, the radiation characteristic of the antenna coil is symmetrical.

Similar to a shape of a foil core, a planar coil is not limited to a circular shape, various shapes including elliptic and polygonal shapes.

Figure 11:
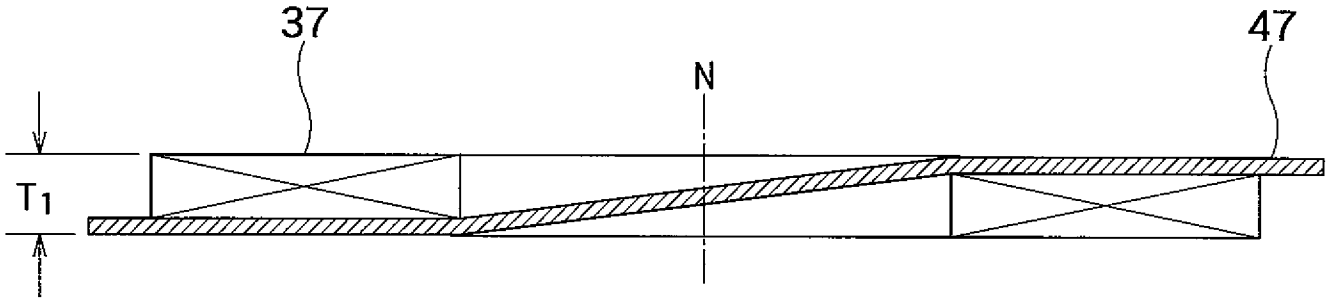
FIG. 11 is a sectional view of the antenna coil showing the thinning thereof.

An antenna coil is preferable to be thinner. FIG. 11 is a longitudinal sectional view showing yet another embodiment of an antenna coil. The thickness $T_1$ of the antenna coil can be made thinner by pressing the planar coil 37 from top and from bottom, or by preliminarily deforming it.

There are various ways of winding a planar coil where winding is started on the inside and ended on the outside. In a common way of winding, as the inner ending is pulled out to the outer periphery of the coil, the thickness of coil increases due to the pulled-out ending.

Figure 12:
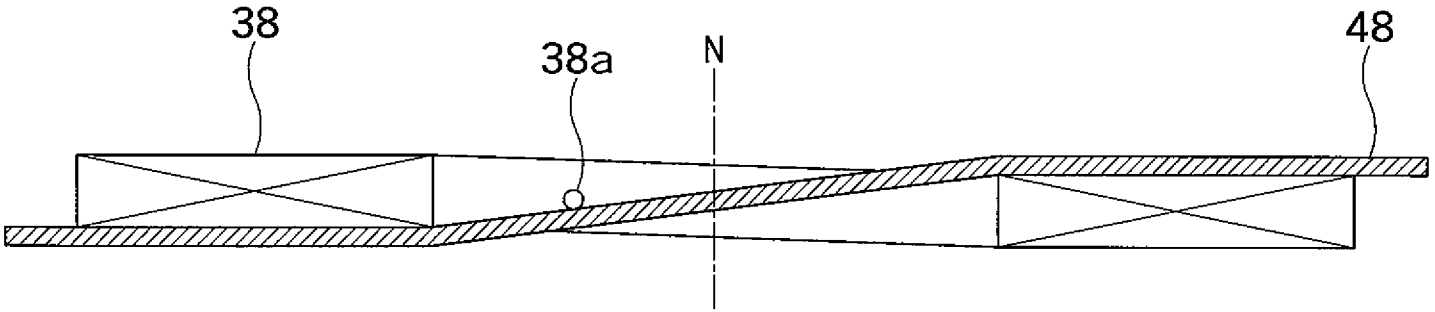
FIG. 12 is a sectional view of the antenna coil showing the position of The ending of the winding for connection.

FIG. 12 is a longitudinal sectional view of an antenna coil for showing the position to bring out the ending of an antenna coil. As shown in FIG. 12, the thickness of an antenna coil can be suppressed by pulling out the inner ending 38*a* of the planar coil 38 through a hole of the planar coil 38 in a direction orthogonal to the longitudinal direction of the foil core 48.

Figure 13B:
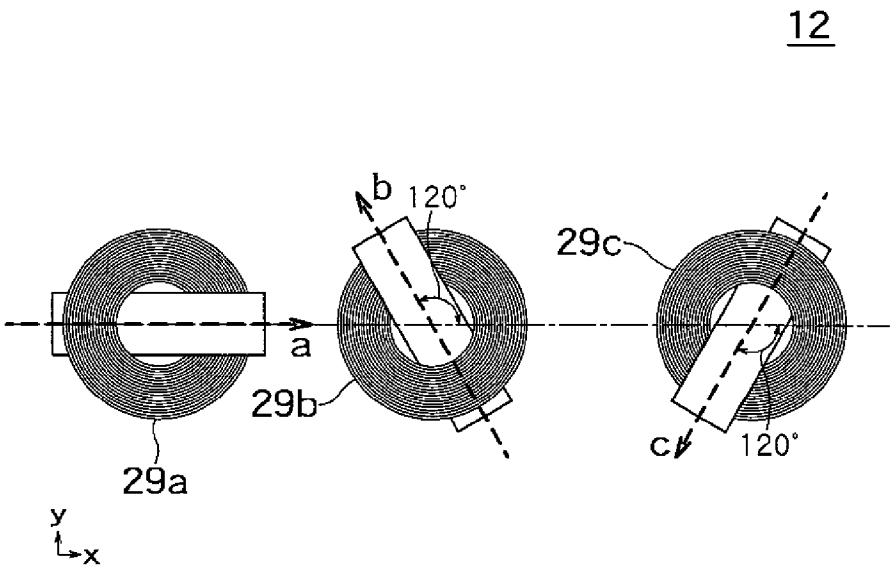
FIG. 13B is a plan view of still another embodiment of the three-axis antenna according to the present invention.
Figure 13A:
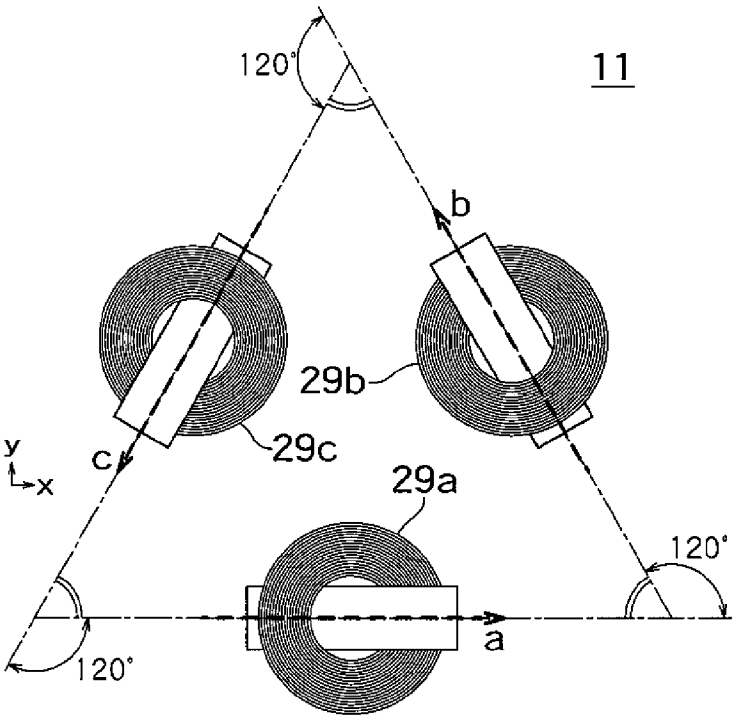
FIG. 13A is a plan view of another embodiment of the three-axis antenna according to the present invention.

FIGS. 13A and 13B are plan views of the other embodiments of the arrangement of antenna coils of a three-axis antenna. The three-axis antenna 11 shown in FIG. 13A has antenna coils 29*a*, 29*b* and 29*c*, whose a axis, b axis and c axis, which represent the foil core's longitudinal directions respectively, are arranged on the respective sides of a regular triangle.

Since the distances among the foil cores of the antenna coils increase, the abovementioned arrangement is beneficial to prevent adverse coupling between the antenna coils which worsen performance.

The three-axis antenna 12 in FIG. 13B has the antenna coils 29*a*, 29*b* and 29*c* lined in a row. As shown here, the antenna coils may be arranged in a plane in any of various ways, provided that the directions of the a axis, the b axis and the c axis, which are the longitudinal directions of the respective foil cores, are correct.

In the abovementioned embodiments, three antenna coils having the same shape and the same characteristic are arranged such that the longitudinal directions of their foil cores make an angle of 120°. Nevertheless, an omni-directional antenna may be realized using antenna coils of different characteristics.

Figure 14:
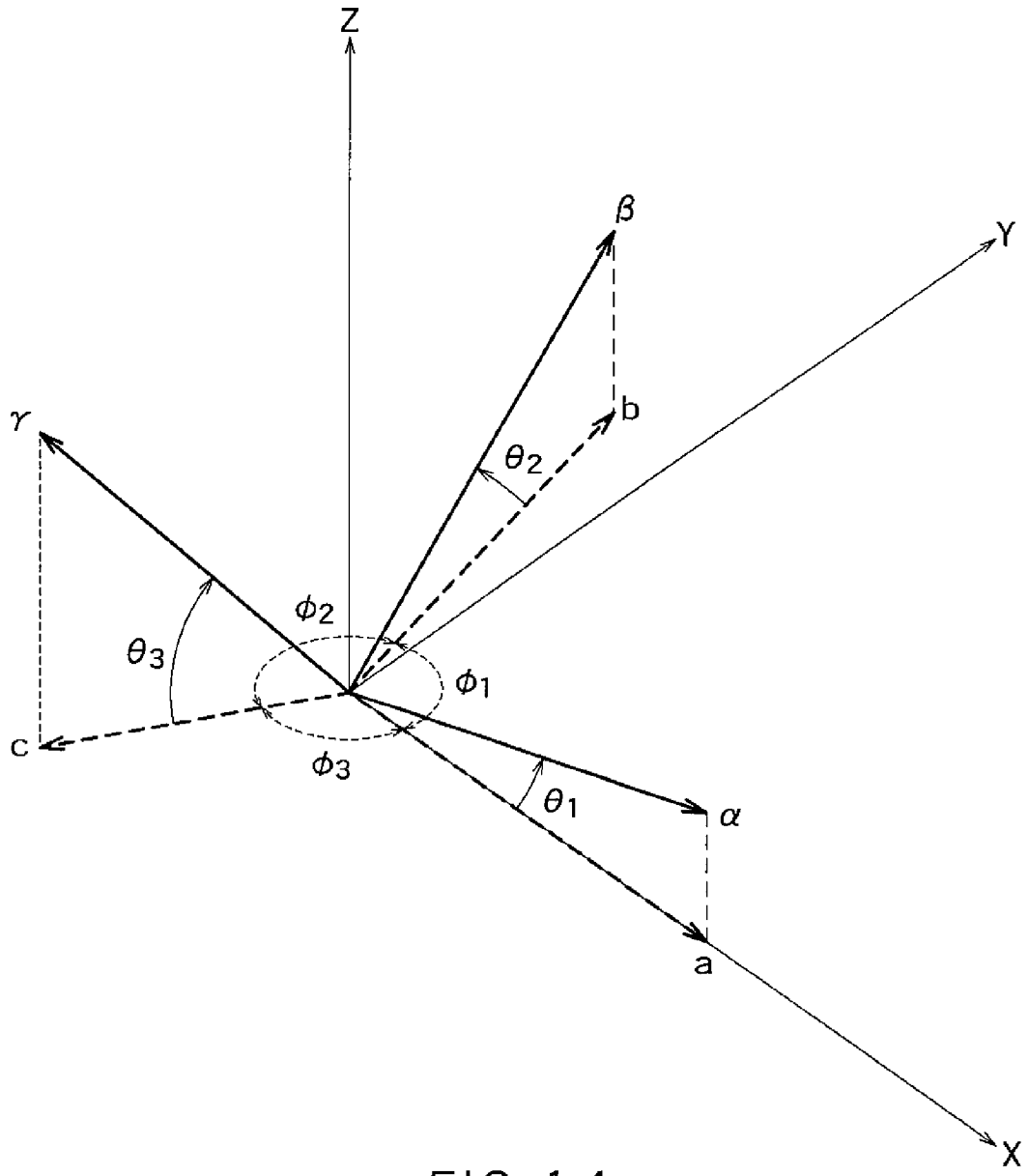
FIG. 14 is a perspective view showing the direction of the maximum reception sensitivity of the three-axis antenna according to the present invention.
Figure 15:
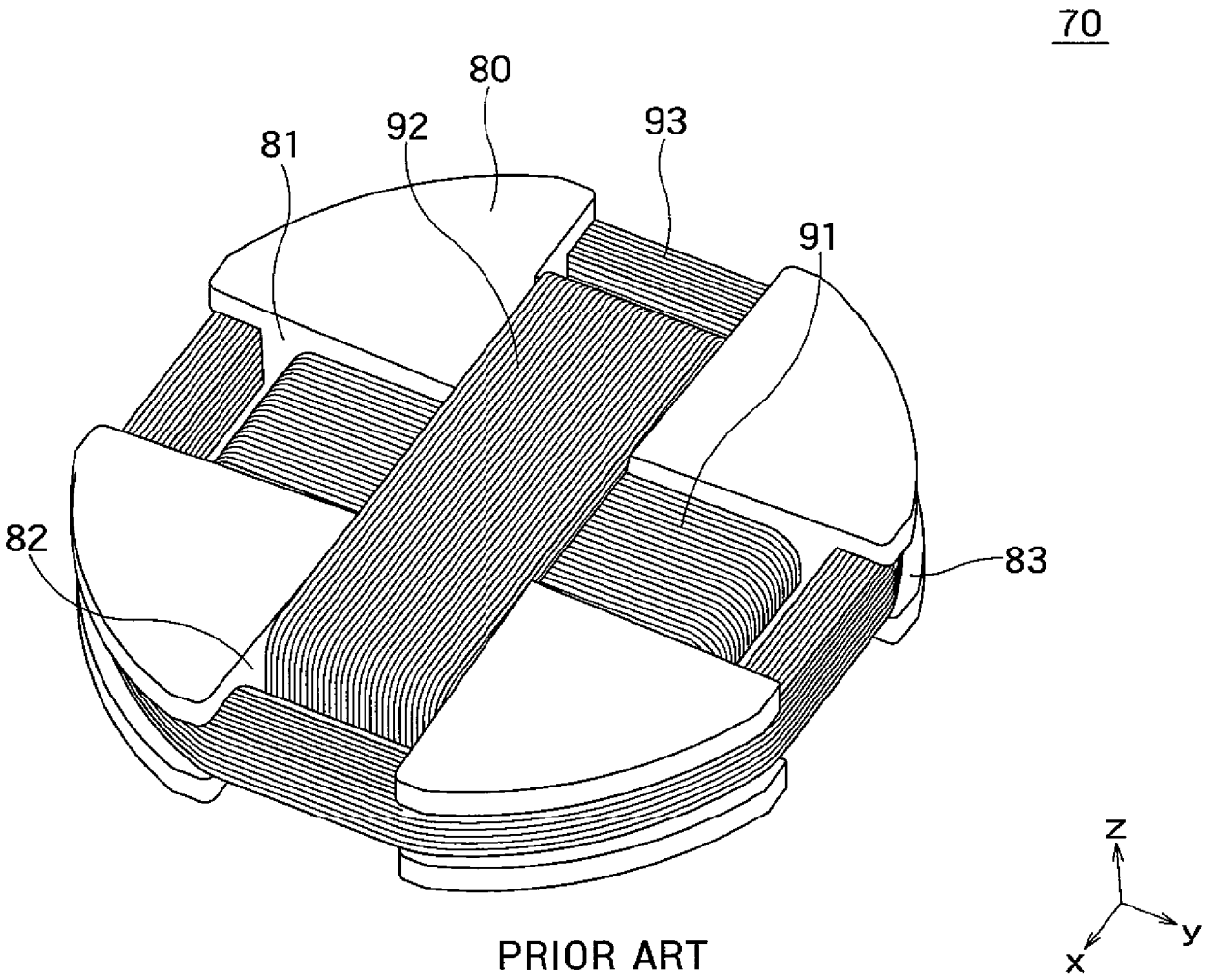
PRIOR ART FIG. 15
FIG. 15 is a perspective view of a conventional three-axis antenna.

FIG. 14 is a characteristics diagram that shows the direction of the maximum reception sensitivity of the three-axis antenna according to the present invention, which is configured to use antenna coils of different characteristics.

In the case the three-axis antenna 10' (not shown), comprising three antenna coils 20*a*', 20*b*' and 20*c*' (not shown) which have different characteristics respectively, are arranged around the point of origin on the same x-y plane, supposing the longitudinal direction of the foil core of the antenna coil 20*a*' is the a axis, the direction of the maximum reception sensitivity is the α axis, and the angle between the a axis and the α axis is $\theta_1$, supposing the longitudinal direction of the foil core of the antenna coil 20*b*' is the b axis, the direction of the maximum reception sensitivity is the β axis, and the angle between the b axis and the β axis is $\theta_2$, supposing the longitudinal direction of the foil core of the antenna coil 20*c*' is the c axis, the direction of the maximum reception sensitivity is the γ axis, and the angle between the c axis and the γ axis is $\theta_3$, and supposing the angle between the a axis and the b axis is $\phi_1$, the angle between the b axis and the c axis is $\phi_2$, the angle between the c axis and the a axis is ϕ3, and supposing that, for example, $\theta_1$=20.00°, $\theta_2$=28.02°, $\theta_3$=54.47°, and $\phi_1$=101.2°, $\phi_2$=138.2°, $\phi_3$=120.6°, the α axis, the β axis and the γ axis can be orthogonal to each other. As a result, an omni-directional antenna may be realized using three antenna coils having different shapes and different characteristics respectively. Here, $\phi_1$, $\phi_2$ and $\phi_3$ are, geometrically, larger than 90° and smaller than 180°.

As mentioned above, when the three planar antenna coils are arranged in the same plane, in the three-axis antenna according to the present invention the directions of the maximum reception sensitivities of the respective antenna coils may be caused to orthogonally cross by adjusting the inclination angles at the antenna coils and the arrangement thereof in the same plane, even if the longitudinal directions of the cores of the respective antenna coils do not orthogonally cross each other. Thus, a three-axis antenna having omni-directional reception sensitivity is made.

Explanation of Codes

10, 11, 12, 70 three-axis antenna
20*a*, 20*b*, 20*c*, 21, 29*a*, 29*b*, 29*c* antenna coil
30, 31, 37, 38 planar coil
38*a* ending of a winding
40, 42, 43, 44, 45, 46, 47, 48 foil core
41*a*, 41*b*, 42*a*, 42*b*, 43*a*, 44*a*, 44*b*, 45*a*, 45*b* core piece
80 core

What is claimed is:

1. A three-axis antenna having a first through a third antenna coils whose directions of maximum reception sensitivity are orthogonal to each other, wherein each of the first to the third antenna coils comprises:

a planar coil being wound around a winding axis in the circumferential direction having an aperture, said planar coil being arranged on a plane; and a core being inserted along the longitudinal direction of the core in the aperture;

wherein at least a part of each of the cores is arranged in a plane to be in parallel to the plane of the first through the third coils.

2. A three-axis antenna according to claim 1, the angles between the directions of the longitudinal directions of the cores of the first to the third antenna coils projected onto the plane being larger than 90° and smaller than 180° in the plane.

3. A three-axis antenna according to claim 2, the angles being 120° , and the first through the third antenna coils having the same shape.

4. A three-axis antenna according to claim 1, the cores having H-shaped, I-shaped or T-shaped planar profiles.

5. A three-axis antenna according to claim 4, the cores having H-shaped, I-shaped or T-shaped planar profiles made by combining multiple core pieces.

6. A three-axis antenna according to claim 1, the inner ending of the planar coil being pulled out from an inner periphery to an outer periphery along a direction orthogonal to the longitudinal direction of the core.

* * * * *